US005261635A

United States Patent [19]

Flathau

[11] Patent Number: 5,261,635

[45] Date of Patent: Nov. 16, 1993

[54] SLAB JOINT SYSTEM AND APPARATUS FOR JOINING CONCRETE SLABS IN SIDE-BY-SIDE RELATION

[75] Inventor: Robert J. Flathau, Cary, Ill.

[73] Assignee: Symons Corporation, Des Plaines, Ill.

[21] Appl. No.: 807,061

[22] Filed: Dec. 9, 1991

[51] Int. Cl.[5] ..... B28B 23/00; E01C 19/50

[52] U.S. Cl. ..... 249/7; 249/93; 249/114.1; 249/189; 249/219.1

[58] Field of Search ..... 249/2, 3, 7, 9, 19, 249/26, 47, 93, 192, 210, 4–6, 91, 96, 44, 208, 219.1, 189, 114.1

[56] References Cited

U.S. PATENT DOCUMENTS

| | | | |
|---|---|---|---|
| 1,379,457 | 5/1919 | Loxterman | 249/7 |
| 1,827,672 | 10/1931 | Rogers | 249/7 |
| 1,936,740 | 11/1931 | Wolf | 249/2 |
| 1,939,007 | 12/1933 | Heltzel | 249/3 |
| 2,661,516 | 12/1953 | Yates | 249/7 |
| 2,772,468 | 12/1956 | Heltzel | 249/3 |
| 3,759,481 | 9/1973 | Scott | 249/189 |
| 3,913,881 | 10/1975 | Gobler et al. | 249/3 |
| 4,533,112 | 8/1985 | Santos, Jr. et al. | 249/3 |
| 4,579,312 | 4/1986 | White | 249/7 |
| 4,616,800 | 10/1986 | Scourtes et al. | 249/4 |
| 4,996,770 | 3/1991 | McCracken | 249/3 |
| 5,076,535 | 12/1991 | Vetter | 249/3 |
| 5,076,536 | 12/1991 | Fitzgerald | 249/3 |

OTHER PUBLICATIONS

Perenchio, W. F. "Avoiding Common Mistakes in Concrete Joint Design" Plant Engineering, p. 70, Jan. 11, 1990.

*Primary Examiner*—Khanh P. Nguyen
*Attorney, Agent, or Firm*—Wood, Phillips, VanSanten, Hoffman & Ertel

[57] ABSTRACT

A slab joint form structure for pouring of a concrete slab with a continuous shear joint including a pair of longitudinally superimposed edge forms, a flat slab joint shear bar positioned in a generally horizontal plane and lying longitudinally between the superimposed edge forms and extending longitudinally thereof, the superimposed wedge forms being engaged with opposite sides of the flat slab joint shear bar, wedge brackets positioned in superimposed stacked relation, the wedge brackets being attached to the edge forms in superimposed aligned relation with the flat slab joint shear bar being between the superimposed brackets, the wedge brackets providing superimposed wedge pockets, a stake located in the superimposed wedge pockets for ground embedment, a locator positioned between one of the edge forms and the shear bar for positioning the shear bar in a proper fixed position relative to the edge forms and leaving an inner edge projected inwardly a predetermined selected distance beyond the closed sides of the edge forms for being embedded in concrete after the concrete has been poured against inside wall faces of the edge forms.

28 Claims, 3 Drawing Sheets

10
11
12
13
14
15
16
17
18
19
20
21
21a
22
3

SLAB JOINT SYSTEM AND APPARATUS FOR JOINING CONCRETE SLABS IN SIDE-BY-SIDE RELATION

FIELD OF THE INVENTION

The present invention relates generally to a concrete slab joint form structure for pouring of a concrete slab with a continuous shear joint embedded in a vertical edge of the slab.

BACKGROUND OF THE INVENTION

In the past, a number of mistakes have been commonly made in the design of slabs on a grade. These mistakes have resulted in extensive concrete cracking within a few days or months after installation. These design mistakes typically occur at contraction, isolation, or construction joints.

A discussion of these problems is set forth further presented in a detailed article entitled: "Avoiding Common Mistakes in Concrete Joint Design" appearing in *Plant Engineering* on Jan. 11, 1990 and attention is directed to this writing for further background concerning the state-of-the-art. My invention concerns certain improvements for solving at least some of the problems there discussed.

It will be appreciated that there is a substantial cost for repairing these types of failures in a busy facility, and for this reason it has been necessary to give considerable attention to attempt to avoid these problems.

My new and improved slab joint system structure herein disclosed relates to an integrated use of specially designed slab edge forms, a slab joint shear bar and, alternatively, an accessory lumber bracket to provide in combination a unique delivery apparatus to apply continuous vertical shear resistance yet allow lateral mobility between two poured in place concrete slabs.

My slab joint apparatus is comprised of: Two (2) channel-shaped slab edge forms which are used to hold the slab joint shear bar during curing of the slab. These have been referred to as slab joint edge forms in this writing.

An expendable continuous joint shear bar which is left in the slab and is encased in the concrete of the subsequent slab is provided. This bar is secured and held in proper position by my new slab joint form structure in the several embodiments herein disclosed.

According to certain features of my invention, accessory brackets can be used in place of the channel-shaped edge forms for filler areas or as an alternate to the channel-shaped edge forms. These components can be referred to as slab joint lumber brackets.

SUMMARY OF INVENTION

Important features of my invention relate to a slab joint form structure for pouring of a concrete slab with a continuous shear joint including a pair of longitudinally superimposed edge forms. My structure further includes a flat slab joint shear bar positioned in a generally horizontal plane and lying longitudinally between the superimposed edge forms and extending longitudinally thereof, the superimposed edge forms being engaged with opposite sides of the flat slab joint shear bar, wedge brackets positioned in superimposed stacked relation, means attaching the wedge brackets to the edge forms in superimposed aligned relation with the flat slab joint shear bar being between the superimposed wedge brackets, the wedge brackets providing superimposed wedge pockets, a stake located in the superimposed wedge pockets for ground embedment, locator means positioned between one of the edge forms and the shear bar for positioning the shear bar in a proper fixed position relative to the edge forms and leaving an inner edge projected inwardly a predetermined selected distance beyond the closed sides of the edge forms for being embedded in concrete after the concrete has been poured against inside wall faces of the edge forms.

The edge forms in one form of my invention each comprise a piece of lumber. According to other features of my invention, the edge forms in another embodiment each comprise steel channels.

According to other important features of my invention, I have provided a slab joint form structure for pouring of a concrete slab with a continuous shear joint. The slab joint structure includes a pair of longitudinally superimposed channel-shaped edge forms defining channels each opening on a common side of the forms and each of the forms has a closed side. A flat slab joint shear bar is positioned in a generally horizontal plane and lies longitudinally between the superimposed channel-shaped edge forms and extends longitudinally thereof. The superimposed channel-shaped edge forms are engaged with opposite sides of the flat slab joint shear bar. Locator means is positioned between one of the edge forms and the shear bar for positioning the shear bar in a proper fixed position relative to the edge forms and leaving an inner edge projected inwardly beyond the closed sides of the channel-shaped edge forms for being embedded in concrete after the concrete has been poured against the closed sides of said channel-shaped edge forms, V-shaped wedge brackets secured in superimposed stacked relation in the channels defined by the superimposed edge forms with the V-shapes of the V-shaped wedge brackets providing superimposed wedge pockets. A stake is located in the superimposed wedge pockets for ground embedment. The brackets each have a pair of aligned transversely extending bolt holes. Wedge bolts each extending through a pair of the aligned bolt holes and through one of said pockets locking the V-shaped wedge brackets in assembly with the stake while the stake is lodged in the superimposed pockets to fix the edge forms against movement.

Yet other features of my invention relate to each of the channel-shaped edge forms having a face plate secured to the closed side of a bottom of the channel for confronting engagement to concrete when the slab is poured, the face plate providing sharp edge corners on a top edge surface of the face plate to enable a sharp slab corner to be formed on a resulting poured slab.

Further features of my invention relate to the channel-shaped edge form having an edge form leg with an upright leg hole, the leg hole has an upset axially projecting annular edge, the shear bar has a bar hole with a diameter larger than the leg hole, the upset axially projecting annular edge is receivable in the bar hole for resisting relative movement of the shear bar with respect to the channel-shaped edge form.

Other features of my invention relate to each of the wedge shaped brackets having flat attachment flanges for abutment against a bottom of the channel when the wedge brackets are lodged therein, and attachment means secures the flat attachment flanges to a bottom of the channel-shaped edge form. The attachment means comprises welds, as illustrated.

Still other features of my invention relate to a slab joint form structure for pouring of a concrete slab with a continuous shear joint including a pair of longitudinally superimposed boards. A flat joint shear bar is positioned in a generally horizontal plane and lies longitudinally between the boards and extending longitudinally thereof. The superimposed boards are engaged with opposite side of the flat joint shear bar. V-shaped wedge brackets are mounted in superimposed stacked relation on one side of superimposed boards providing superimposed wedge pockets. Means secures the brackets to the superimposed boards. The brackets each have a bracket plate engaged flatwise against the flat shear bar. A stake is located in the superimposed wedge pockets for ground embedment. The brackets each have a pair of aligned bolt holes. Wedge bolts are each extended through a pair of the aligned bolt holes locking the wedge brackets in assembly with the stake while the stake is lodged in the superimposed pockets to fix the boards against movement.

Yet still other features relate to the V-shaped wedge brackets each having an angled plate portion including an upright plate flange with the means securing the upright plate flange to the associated one of the superimposed stacked boards.

A slab joint form structure for pouring of a concrete slab with a continuous shear joint including a pair of longitudinally superimposed boards, a flat joint shear bar positioned in a generally horizontal plane and lying longitudinally between the boards and extending longitudinally thereof, the superimposed boards being engaged with opposite side of the flat joint shear bar, wedge-shaped brackets mounted in superimposed stacked relation on one side of superimposed boards said wedge-shaped brackets having superimposed wedge pockets, means securing the brackets to said superimposed boards, said brackets each having a bracket plate engaged flatwise against said flat shear bar, a stake located in said superimposed wedge pockets for ground embedment, the brackets each having a pair of aligned bolt holes, and wedge bolts each extending through a pair of the aligned bolt holes locking the wedge brackets in assembly with the stake while the stake is lodged in said superimposed pockets to fix said boards against movement.

BRIEF DESCRIPTION OF THE DRAWINGS

Other objects and features of my invention will become more fully apparent in view of the following detailed description of the drawings illustrating several embodiments.

DESCRIPTION OF A PREFERRED EMBODIMENT

Figures 1, 2, 3:
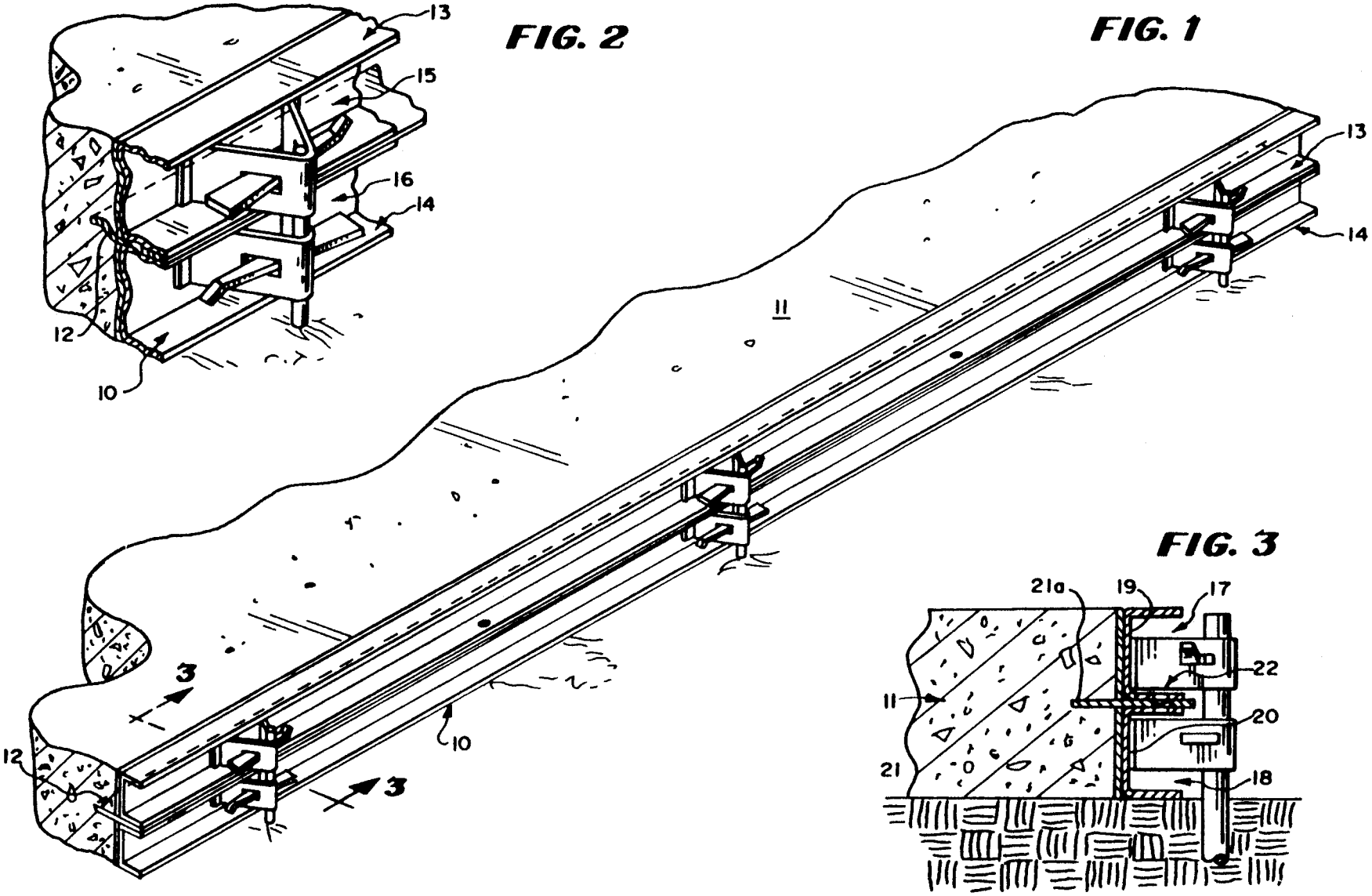
FIG. 1 is an enlarged perspective view of a pair of slab joint forms shown after a concrete slab has been poured illustrating the slab joint shear bar embedded in the concrete slab.
FIG. 2 is an enlarged fragmentary partially sectioned view of a slab joint structure embodying important features of my invention.
FIG. 3 is an enlarged fragmentary vertical section taken on the line 3—3 looking in the direction indicated by the arrows as seen in FIG. 2.

The present invention particularly concerns a new and improved slab joint form structure 10 for pouring of a concrete slab 11. According to important features of my invention, the slab joint form structure 10 is particularly adapted to form a continuous shear joint 12 in the slab 11 which joint and slab are formed in such a way so as to conform with high standards as now required in the industry.

The slab joint form structure 10 includes a pair of longitudinally superimposed channel-shaped edge forms 13 and 14. These forms 13 and 14 are preferably comprised of steel and can be of any suitable length. The forms 13 and 14 define longitudinally extending channels 15 and 16 which channels have openings 17 and 18 on a common side of the forms 13 and 14. Each of the forms has a closed side or channel bottom indicated generally at 19 and 20.

The slab joint form structure 10 includes a flat slab joint shear bar 21 comprised of steel and which can be of any suitable length, width and thickness. This shear bar is located between the superimposed channel-shaped edge forms 13 and 14 as is shown in FIG. 3, as an example. The flat slab joint shear bar must be physically positioned against relative movement with respect to the edge forms 13 and 14 and to this end locator structure or means 22 is positioned between the edge forms 13 and 14 to serve this purpose according to other important features of my invention. By locking the position of the shear bar 21 with respect to the edge forms 13 and 14, a proper continuous shear joint 12 can be formed in the concrete slab 11 after it has been poured. Several of the end locator structures or means 22 insures that an inner and outer edge of the bar is maintained parallel to the edge forms 13 and 14. According to other features of my invention, the edge forms 13 and 14 can be readily stripped from the shear bar 21 since the locator structure or means 22 can be easily separated by lifting the upper edge form 13 away from the lower form 14.

From a study of the structure described to this point, it will be apparent that the locator structures 22 are positioned between one of the edge forms and the shear bar 21 at longitudinally spaced intervals as seen in FIG. 3 so that the shear bar 21 can be maintained in a proper fixed position relative to the edge forms 13 and 14 leaving an inner end or edge 20*a* projected inwardly beyond the closed channel bottoms 19 and 20 so that the inner end or edge 21*a* can be embedded in concrete after the concrete has been poured against the closed sides 19 and 20 of the channel-shaped edge forms 19 and 20.

According to other features of my invention, I have provided V-shaped wedge brackets 23 and 24 which are secured by welds 25 and 26 to the edge forms 13 and 14 and more particularly to the channel bottoms 19 and 20 in unitary assembly therewith. These wedge brackets are preferably V-shaped but other shapes might be used without departing from my invention. These brackets 23 and 24 are adapted to be positioned in superimposed stack relation with the edge forms 13 and 14 in such a way as to provide superimposed wedge pockets 27 and 28. A stake 29 is adapted to extend through the pockets 27 and 28 and to be held or lodged against the inside edge of the bottom of the V-shaped superimposed wedge brackets 23 and 24. Excellent results can be attained using a ¾" stake. The brackets 23 and 24 each are provided with a pair of aligned transversely extending bolt holes 30,30 and 31,31. Wedge bolts 32,33 are adapted to extend through the holes 30,30 and 31,31 so as to be secured with the wedge brackets 23 and 24 thus locking the stake 29 in the superimposed wedge pockets 27 and 28. These wedge bolts 32 and 33 serve to hold the stake 29 in snug engagement with an inner surface area of the V-shaped wedge bracket thus insuring that the superimposed channel-shaped edge forms 13 and 14 can be locked in a fixed position after the wedge bolts 32 and 33 have been engaged within the wedge brackets 23 and 24. These components can be readily disassembled by driving the wedge bolts 32 and 33 out of the bolt holes 30,30 and 31,31 thus freeing the superimposed channel-shaped edge forms from being in locked assembly with the stake 29. The stake 29 can then be pulled out leaving the slab joint shear bar 21 in embedded assembly with the concrete slab 11 once the edge forms 13 and 14 have been stripped away from the slab 11.

Figure 6:
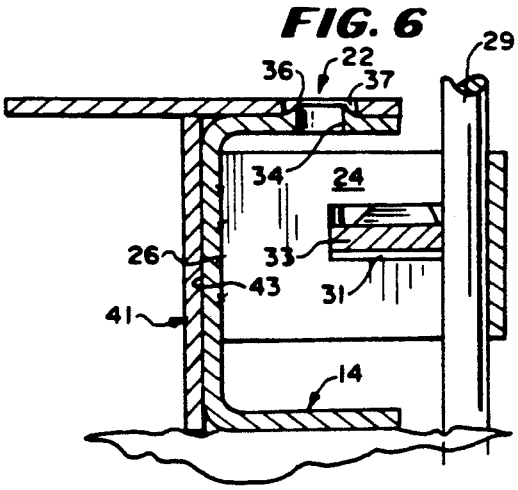
FIG. 6 is an enlarged fragmentary vertical section taken on the line 6—6 looking in the direction indicated by the arrows as seen in FIG. 5.

The locator means or structure 22 is most clearly shown in FIG. 6. More particularly, an upright leg hole 34 is shown there. The leg hole 34 is located in an outwardly extending channel leg 35 of the channel-shaped edge form 14. The leg hole 34 has an upset dimple which is also herein described as an axially projecting edge area or annular edge 36. The shear bar 21 has a bar hole 37 with an adequate diameter for receiving the upset axially projecting edge area 36 when the shear bar is placed on top of the edge form 14. Another feature of my locator means is also to properly align the edge forms 14 and 15 with respect to the shear bar 21 before the concrete is poured. Since the locator means is provided, the edge forms can be easily lined up with respect to one another and with respect to the shear bar 21.

Figure 4:
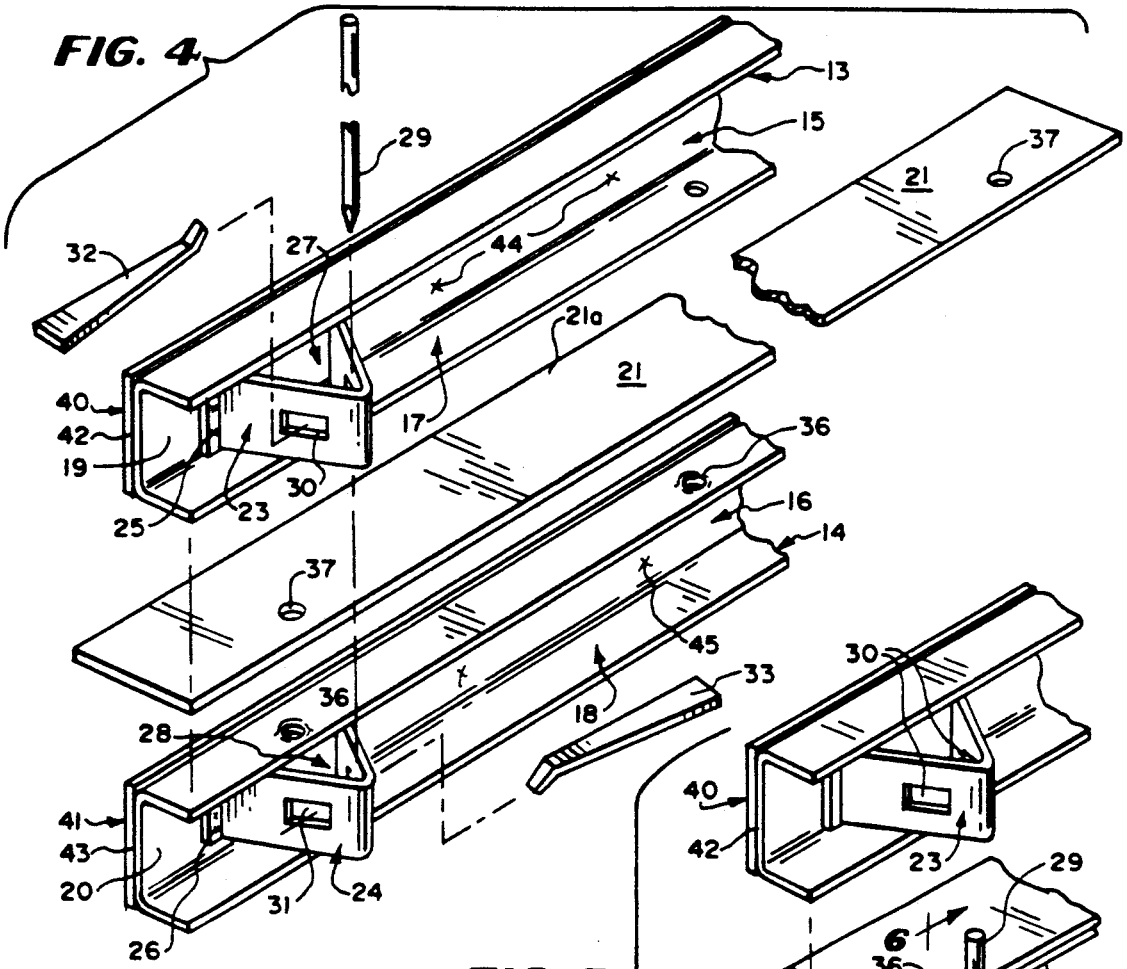
FIG. 4 is an exploded view of my slab joint structure as previously illustrated in FIGS. 1-3.
Figure 5:
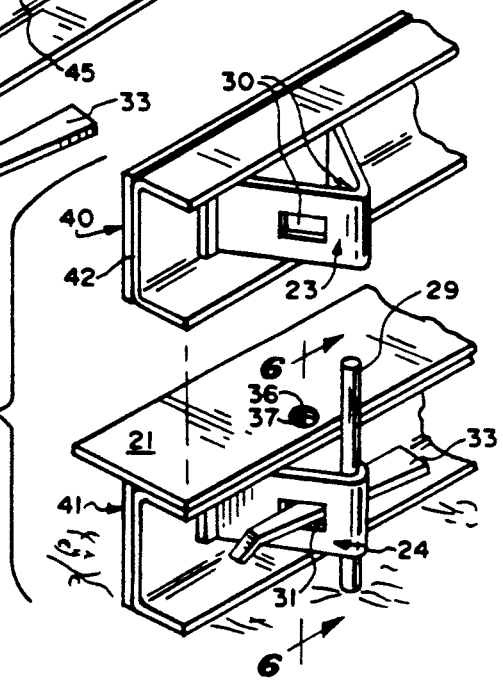
FIG. 5 is an enlarged exploded view of a pair of slab joint forms mounted in superimposed relationship relative to a slab joint shear bar.
Figure 7:
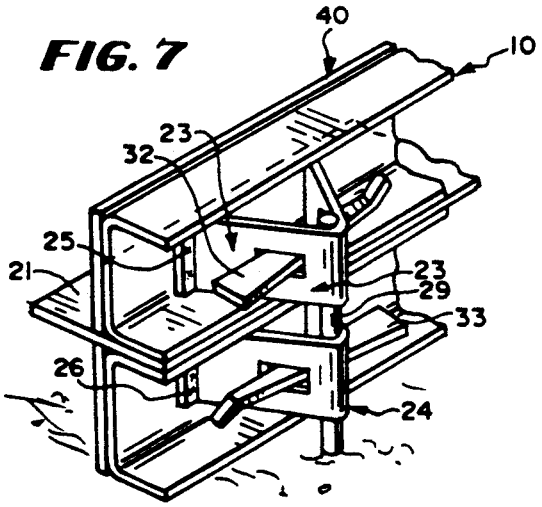
FIG. 7 is an enlarged fragmentary perspective view of the superimposed slab joint forms secured together to comprise a slab joint structure.
Figure 8:
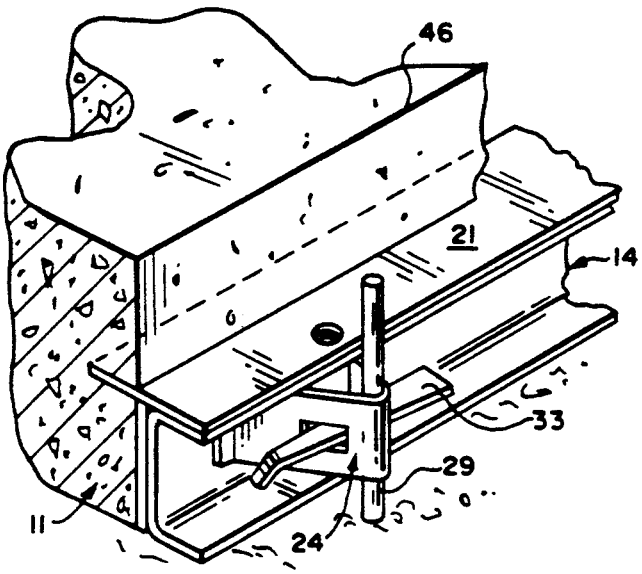
FIG. 8 is an enlarged fragmentary perspective view of the slab joint structure illustrated in FIG. 1 only with one of the slab joint forms being removed preparatory to removing the remaining slab joint form after the concrete has solidified.
Figure 9:
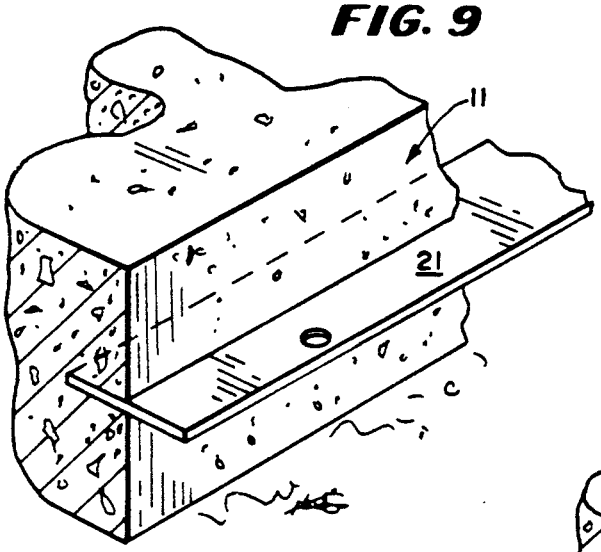
FIG. 9 is an enlarged fragmentary perspective view similar to FIG. 8 only with the other or lower the slab joint form having been removed leaving the slab joint shear bar embedded in the formed concrete.

The edge forms 13 and 14 are further provided with face plates 40,41 to back sides 42,43 of the edge forms 13 and 14 by welds 44,45 (FIG. 4). Each of the face plates provide a sharp edge corner 46 on the concrete slab 11 when poured (FIG. 8). In FIG. 8, I have shown the upper edge form 13 stripped away with the lower edge form 14 still in place for the purpose of clearly illustrating the sharp nature of the corner 46 that is formed through the use of my slab joint form structure 10. In FIG. 9, both of the edge forms 13 and 14 have been removed and this view clearly shows the way in which the shear bar 21 is left embedded in the slab 11.

Figure 10A:
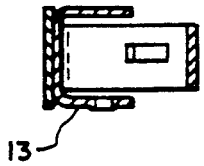
FIGS. 10A, 10B, and 10C are vertical sections of my slab joint forms and illustrating dimple upsets provided in form legs.
Figure 10B:
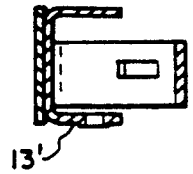
Figure 10C:
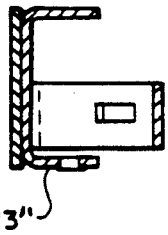

In FIG. 10A, 10B, and 10C I have illustrated a series of edge forms 13,13' and 13" which are of different sizes for heights of 5", 6", 7", or 8", as may be required. Each of these forms has the dimple upsets of the type that are generally indicated at 36 in FIG. 3 only with the dimple upsets extending downwardly rather than upwardly. Thus it will be evident that the dimple upsets can be located either on the upper channel-shaped edge form 13 or on the lower channel-shaped 14 as may be required.

DISCUSSION OF ADVANTAGES OF MY SLAB JOINT EDGE FORMS

The purpose of the slab joint edge forms is to provide a convenient, labor savings method of placing the slab joint shear bar at the proper uniform height and slab depth along the entire edge of the slab.

The notable features of the slab joint edge forms area as follows:

The rigid, channel-shaped construction provides a very accurate and straight surface along the entire length of the slab edge and a surface on which screeding equipment can be supported.

The face plate added to the front surface (concrete slab) of the form provides sharp edge corners on the top surface of the resulting poured slab.

Slab joint edge forms are used both under and over the slab joint shear bar. The identical forms used in a two piece combination provide an unobstructed method of shear bar placement, i.e. the bottom form is placed first, then the shear bar is placed on the form, and a significant advantage on stripping out the forms, i.e. the top form and wedge are removed to provide access to the bottom form. The two identical forms also provide less weight per item, improved production because of application simplicity and increased utilization since they may be used either on top or bottom.

The selected heights chosen for the face dimensions of the forms allow the forms to be mixed to meet common slab thicknesses.

The built in stake pockets with wedges provide a method to grade the bottom forms at a specific height while the stake pocket in the top form is used to clamp the top form, the shear bar and the bottom form together in a tight, grout resistant seal.

The dimple upset located in one flange provides accurate depth and horizontal location of the shear bar through use of matching holes in the shear bar. This feature enhances the rapid placing of the shear bar on the bottom form with visual inspection for proper seating of the bar on the form.

DISCUSSION OF SLAB JOINT SHEAR BAR

The purpose of the slab joint shear bar is to provide resistance to vertical shear and eliminate the need for keyways or slab dowels while providing freedom for differential slab movement during curing which could cause surface cracking. This item is expendable as it is left in place between two slabs.

The strategically sized and placed holes in the shear bar provide proper location of the bar when they match up with the dimple upsets of the slab joint edge forms and slab joint lumber brackets.

The strategically sized and placed holes also provide bonding access areas to fix the shear bar in the subsequent slab pour. In this manner the desired joint having one slab edge free to move horizontally and one edge solidly fixed is achieved.

The strategically placed holes also provide the ability of the shear bar to be lapped between two sets of forms. This feature allows the shear bar to be used as an aligner and splice between two sets of forms.

The width and thickness of the shear bar provides both the proper material area to resist shearing and the proper dimension for clamping and positioning the shear bar between the forms.

DISCUSSION OF SLAB JOINT LUMBER BRACKET IN FIGS. 11 AND 12

Figure 12:
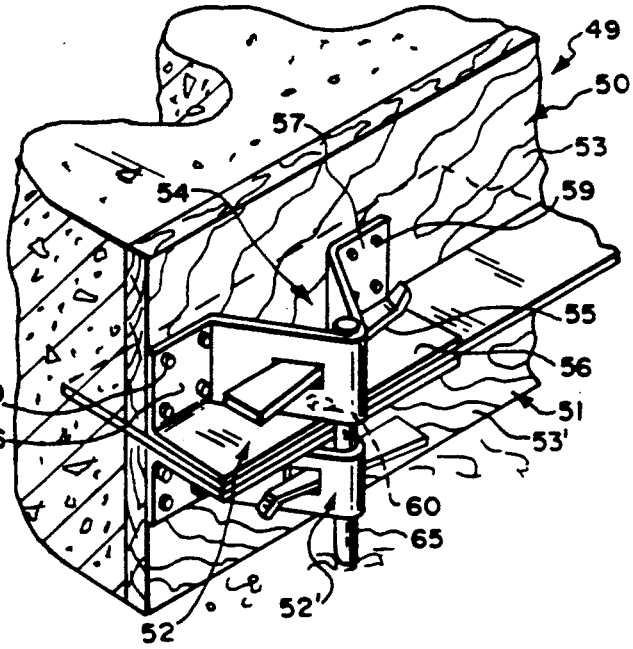
FIG. 12 is an enlarged fragmentary perspective view of the bracket shown in FIG. 11 showing the manner of assembly of the bracket with pieces of lumber to provide a slab joint lumber form which also embodies important features of my invention.
Figure 11:
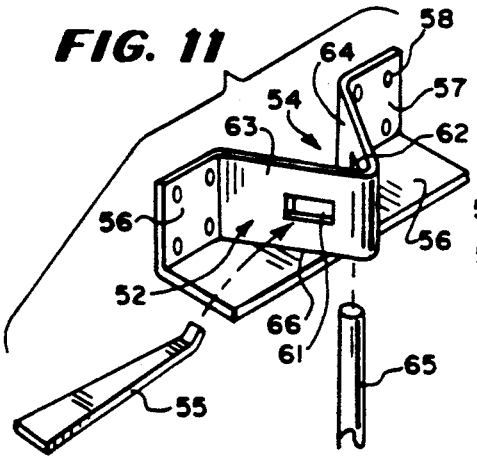
FIG. 11 is an exploded fragmentary view of a slab joint lumber bracket for use in the creation of a slab joint lumber bracket form.

Shown in FIGS. 11 and 12 is a modified type of a slab joint form structure 49. In this instance, the structure includes a pair of edge forms 50 and 51 having steel brackets 52,52'. The edge forms are each comprised of a pair of superimposed boards 53 and 53'.

The purpose of my slab joint lumber brackets 52,52' are each to provide an apparatus to permit non standard slab edge lengths as an alternate placing device to the slab joint edge form. It embodies many of the same features as the slab joint edge form but allows the use of lumber in place of the rigid formed metal channels. The V-shaped wedge brackets 52,52' each consists of a V-shaped stake pocket 54, a wedge 55, and a positioning plate 55.

The stake pocket 54 has flanges 56 and 57 with holes 58 to allow it to be affixed by nailing or screwing at 59 to lumber of any appropriate size.

The positioning plate contains a dimple upset diagramatically shown at 60 at the same location and size as the slab joint edge form to allow the slab joint bracket to position the shear bar in the fashion as the edge form. The upsets also allow the bracket itself to be properly spaced before they are attached to lumber. The wedges 55 are insertable through confronting wedge bracket slots 61 and 62 in bracket legs 63 and 64 and co-act with the stake 65 when the stake 65 is lodged in the pocket 54 to fixedly position the edge forms 51 and 52 in the same way previously described.

The bracket is formed as a welded unit and the plate 56 is welded to the underside of the legs or flanges 56 and 57 and to the underside of the legs 63 and 64.

The plate 56 is formed integral with the flanges 56 and 57 but is bent to underlie the V-shaped bracket legs 63 and 64. Bottom edges 66 of legs 63 and 64 can be welded to the plate 56, if desired.

Once affixed to lumber the slab joint lumber brackets in assembly with the lumber achieve the same features and benefits described for the slab joint edge forms except for more limited rigidity, durability and finished edge quality compared to the slab joint edge form.

It should be clear that the novelty of the slab joint system is with the labor savings features and the systematic delivery of the pre-existing concept of continuous flat steel bars for use along slab joints to control slab movement.

I claim:

1. A slab joint form structure for pouring of a concrete slab with a continuous sheer joint including a pair of longitudinally superimposed edge forms, a flat slab joint shear bar positioned in a generally horizontal plane and lying longitudinally between the superimposed edge forms and extending longitudinally thereof, the superimposed edge forms being engaged with opposite sides of the flat slab joint shear bar, wedge brackets positioned along each of said edge forms, means attaching said wedge brackets to said edge forms in superimposed aligned relation with said flat slab joint shear bar being between said superimposed wedge brackets, the wedge brackets extending outwardly of said edge forms and providing superimposed wedge pockets at a point beyond said edge forms and said shear bar, a stake located in said superimposed wedge pockets to pass by said edge forms and said shear bar for ground embedment at a point outwardly thereof, locator means positioned between one of said edge forms and said shear bar for positioning said shear bar in a proper fixed position relative to said edge forms and leaving an inner edge projected inwardly a predetermined selected distance beyond the closed sides of said edge forms for being embedded in concrete after the concrete has been poured against inside wall faces of said edge forms.

2. The slab joint form structure of claim 1 wherein the brackets each having a pair of aligned transversely extending bolt holes, and wedge bolts each extending through a pair of the aligned bolt holes and through one of said pockets locking the wedge brackets in assembly with the stake while the stake is lodged in said superimposed pockets to fix said edge forms against movement.

3. The slab joint form structure of claim 1 wherein each of said edge forms has a face plate secured to inside wall faces of said edge forms for confronting engagement to concrete when the slab is poured, the face plate providing sharp edge corners on a top edge surface of the face plate to enable a sharp slab corner to be formed on a resulting poured slab.

4. The slab joint form structure of claim 1 wherein said edge forms each comprise a piece of lumber.

5. The slab joint form structure of claim 4 with said wedge brackets being secured by said attaching means at longitudinally spaced intervals to said pieces of lumber, said attaching means comprising fasteners.

6. The slab joint form structure of claim 1 wherein each of said edge forms being comprised of steel channels.

7. The slab joint form structure of claim 6 wherein each of said wedge brackets is V-shaped and is located and fastened in said channels by said attaching means.

8. The slab joint form structure of claim 1 wherein said edge forms are each channel-shaped, each of the channel-shaped edge forms having an edge form leg with an upright leg hole, the leg hole having an upset axially projecting annular edge, said shear bar having a bar hole with a diameter larger than the leg hole, said upset axially projecting annular edge being receivable in said bar hole for resisting relative movement of said shear bar with respect to the channel-shaped edge form.

9. The slab joint form structure of claim 1 wherein said edge forms are each channel-shaped, each of said channel-shaped edge forms having a face plate secured to a back side of an associated one of said edge forms for confronting engagement with a concrete slab when poured, the face plate providing sharp edge corners on a top surface of a resulting poured slab, the channel-shaped edge form having an edge form leg with an upright leg hole, the upright leg hole having an upset axially projecting annular edge, said shear bar having a bar hole with a diameter larger than the leg hole, said upset axially projecting annular edge being receivable in said bar hole for resisting relative movement of said shear bar with respect to the channel-shaped edge form.

10. The slab joint form structure of claim 1 wherein each of the wedge brackets is V-shaped, the V-shaped brackets each having flat attachment flanges for abutment against a bottom of a channel in the respective one of the edge forms when the wedge brackets are lodged therein, and said attaching means securing said flat attachment flanges to the bottom of said channels in said edge forms.

11. The slab joint form structure of claim 10 wherein said attaching means comprises welds.

12. The slab joint form structure of claim 1 wherein said edge forms are each channel-shaped, said locator means includes an upright leg hole, the leg hole being located in an outwardly extending leg of the edge form, the leg hole having an upset axially projecting edge area, said shear bar having a bar hole with an adequate diameter for receiving said upset axially projecting edge area in locked assembly for resisting sliding movement of said shear bar and the channel-shaped edge form locked thereto.

13. The slab joint form structure of claim 12 wherein said attaching means comprises welds which secure each of said wedge brackets to an associated one of said edge forms.

14. A slab joint form structure for pouring of a concrete slab with a continuous shear joint including a pair of longitudinally superimposed channel-shaped edge forms defining channels each opening on a common side of the forms and each of said forms having a closed side, a flat slab joint shear bar positioned in a generally horizontal plane and lying longitudinally between the superimposed channel-shaped edge forms and extending longitudinally thereof, the superimposed channel-shaped edge forms engaged with opposite sides of the flat slab joint shear bar, locator means positioned between one of said edge forms and said shear bar for positioning said shear bar in a proper fixed position relative to said edge forms and leaving an inner edge projected inwardly beyond the closed sides of said channel-spaced edge forms for being embedded in concrete after the concrete has been poured against the closed sides of said channel-shaped edge forms, V-shaped wedge brackets secured in superimposed stacked relation in the channels defined by said superimposed edge forms and extending outwardly of said edge forms with the V-shapes of the V-shaped wedge brackets providing superimposed wedge pockets at a point beyond said edge forms and said shear bar, a stake located in said superimposed wedge pockets to pass by said edge forms and said shear bar for ground embedment at a point outwardly thereof, the brackets each having a pair of aligned transversely extending bolt holes, and wedge bolts each extending through a pair of the aligned bolt holes and through one of said pockets locking the V-shaped wedge brackets in assembly with the stake while the stake is lodged in said superimposed pockets to fix said edge forms against movement.

15. The slab joint form structure of claim 14 wherein each of said channel-shaped edge forms has a face plate secured to said closed side of a bottom of the channel for confronting to said closed side of a bottom of the channel for confronting engagement to concrete when the slab is poured, the face plate providing sharp edge corners on a top edge surface of the face plate to enable a sharp slab corner to be formed on a resulting poured slab.

16. The slab joint form structure of claim 14 wherein the channel-shaped edge form has an edge form leg with an upright leg hole, the leg hole having an upset axially projecting annular edge, said shear bar having a bar hole with a diameter larger than the leg hole, said upset axially projecting annular edge being receivable in said bar hole for resisting relative movement of said shear bar with respect to the channel-shaped edge form.

17. The slab joint form structure of claim 14 wherein each of said channel-shaped edge forms has a face plate secured to a back side of an associated one of said edge forms for confronting engagement with a concrete slab when poured, the face plate providing sharp edge corners on a top surface of a resulting poured slab, the channel-shaped edge form having an edge form leg with an upright leg hole, the upright leg hole having an upset axialy projecting annular edge, said shear bar having a bar hole with a diameter larger than the leg hole, said upset axially projecting annular edge being receivable in said bar hole for resisting relative movement of said shear bar with respect to the channel-shaped edge form.

18. The slab joint form structure of claim 14 wherein each of the wedge shaped brackets has flat attachment flanges for abutment against a bottom of the channel when the wedge brackets are lodged therein, and attachment means securing said flat attachment flanges to a bottom of said channel-shaped edge form.

19. The slab joint form structure of claim 18 wherein said attachment means comprises welds.

20. The slab joint form structure of claim 14 wherein said locator means includes an upright leg hole, the leg hole being located in an outwardly extending leg of said channel-shaped edge form, the leg hole having an upset axially projecting edge area, said shear bar having a bar hole with an adequate diameter for receiving said upset axially projecting edge area in locked assembly for resisting sliding movement of said shear bar and the channel-shaped edge form locked thereto.

21. The slab joint form structure of claim 14 wherein weld means secures each of said V-shaped wedge brackets to an associated one of said channel-shaped edge forms.

22. A slab joint form structure for pouring of a concrete slab with a continuous shear joint including a pair of longitudinally superimposed forms, a flat joint shear bar positioned in a generally horizontal plane and lying longitudinally between the forms and extending longitudinally thereof, the superimposed forms being engaged with opposite sides of the flat joint shear bar, wedge-shaped brackets mounted in superimposed stacked relation on one side of the superimposed forms, said wedge-shaped brackets having superimposed wedge pockets, means securing the brackets to said superimposed forms, said brackets each having a bracket plate engaged flatwise against said flat shear bar, a stake located in said superimposed wedge pockets for ground embedment, the brackets each having a pair of aligned bolt holes, and wedge bolts each extending through a pair of the aligned bolt holes locking the wedge brackets in assembly with the stake while the stake is lodged in said super imposed pockets to fix said forms against movement.

23. The slab joint form structure of claim 22 wherein locator means is positioned between one of said forms and said shear bar for positioning said shear bar in a proper fixed position relative to said forms and leaving an inner edge projected inwardly beyond said forms for being embedded in concrete after the concrete has been poured against said forms.

24. The slab joint form structure of claim 23 wherein the bracket plate has an upright leg hole, the upright leg hole having an upset dimple, said shear bar having a bar hole with a diameter larger than the leg hole, said upset dimple being receivable in said bar hole for resisting relative movement of said shear bar with respect to the form.

25. The slab joint form structure of claim 22 wherein each of the wedge shaped brackets has flat attachment flanges for abutment against the respective one of the forms, and attachment means securing said flat attachment flanges to said forms.

26. The slab joint form structure of claim 22 including locator means comprising an upright leg hole, the leg hole being located in the bracket plate, the leg hole having an upset axially projecting edge area, said shear bar having a bar hole with an adequate diameter for receiving said upset axially projecting edge area in locked assembly for resisting sliding movement of said shear bar and the form locked thereto. said shear bar and the channel-shaped edge form locked thereto.

27. The form structure of claim 22 wherein said wedge-shaped brackets each having an angled plate portion including an upright plate flange with said securing means securing said upright plate flange to the associated one of the superimposed stacked forms.

28. The form structure of claim 22 wherein said forms are comprised of lumber, said wedge-shaped brackets being V-shaped, and the V-shape having V-oriented bracket legs.

* * * * *